US010989093B2

(12) United States Patent
Lei et al.

(10) Patent No.: US 10,989,093 B2
(45) Date of Patent: Apr. 27, 2021

(54) SYSTEM FOR ADAPTIVE REGENERATION OF AFTERTREATMENT SYSTEM COMPONENTS

(71) Applicant: Cummins Emission Solutions Inc., Columbus, IN (US)

(72) Inventors: Yinghuan Lei, Columbus, IN (US); Todd A. Corbet, Franklin, IN (US); Robert Edward Cochran, Columbus, IN (US); Sergio M. Hernandez-Gonzalez, Greenwood, IN (US); Uma Vajapeyazula, Columbus, IN (US); Weichao Wang, Columbus, IN (US); Marc A Greca, Bargersville, IN (US); Joseph M. Brault, Columbus, IN (US)

(73) Assignee: Cummins Emission Solutions Inc., Columbus, IN (US)

( * ) Notice: Subject to any disclaimer, the term of this patent is extended or adjusted under 35 U.S.C. 154(b) by 59 days.

(21) Appl. No.: 16/325,673

(22) PCT Filed: Aug. 14, 2017

(86) PCT No.: PCT/US2017/046755
§ 371 (c)(1),
(2) Date: Feb. 14, 2019

(87) PCT Pub. No.: WO2018/035042
PCT Pub. Date: Feb. 22, 2018

(65) Prior Publication Data

US 2019/0203627 A1 Jul. 4, 2019

Related U.S. Application Data

(60) Provisional application No. 62/375,130, filed on Aug. 15, 2016.

(51) Int. Cl.

| | |
|---|---|
| ***F01N 3/02*** | (2006.01) |
| ***F01N 3/20*** | (2006.01) |
| ***F01N 9/00*** | (2006.01) |
| ***F02D 41/02*** | (2006.01) |

(52) U.S. Cl.
CPC ..... *F01N 9/00* (2013.01); *F01N 3/02* (2013.01); *F01N 3/20* (2013.01); *F01N 3/2086* (2013.01);
(Continued)

(58) Field of Classification Search
CPC . F01N 3/02; F01N 3/20; F01N 3/2086; F01N 9/00; F02D 41/021; F02D 41/027;
(Continued)

(56) References Cited

U.S. PATENT DOCUMENTS

| | | | |
|---|---|---|---|
| 7,036,305 | B2 | 5/2006 | Nishimura |
| 7,082,754 | B2 | 8/2006 | Otake et al. |

(Continued)

OTHER PUBLICATIONS

International Search Report and Written Opinion issued for PCT/US2017/046755, dated Nov. 3, 2017, 10 pages.

*Primary Examiner* — Audrey K Bradley
*Assistant Examiner* — Dapinder Singh
(74) *Attorney, Agent, or Firm* — Foley & Lardner LLP

(57) ABSTRACT

Systems, methods, and apparatuses for adaptive regeneration of aftertreatment system components. The system may include an aftertreatment system and a controller. The controller is configured to access one or more parameters indicative of an ambient condition, determine a regeneration type of a regeneration process for a component of the aftertreatment system, determine an application in condition, and modify a parameter for the regeneration process for the component of the aftertreatment system. In some instances, the controller initiates the regeneration process. In some instances, the one or more parameters include an
(Continued)

ambient air temperature, a reductant tank temperature, or a particulate matter sensor temperature. In some instances, the modified parameter includes a target regeneration temperature, a regeneration duration, a dwell time between regeneration process, a threshold value for the regeneration process, or a minimum regeneration temperature.

20 Claims, 4 Drawing Sheets

(52) U.S. Cl.
CPC ..... *F02D 41/021* (2013.01); *F02D 41/027* (2013.01); *F02D 41/029* (2013.01); *F02D 2200/021* (2013.01); *F02D 2200/0804* (2013.01); *F02D 2200/0806* (2013.01); *F02D 2200/0812* (2013.01); *F02D 2200/0818* (2013.01); *F02D 2200/101* (2013.01); *F02D 2200/50* (2013.01); *F02D 2200/501* (2013.01); *F02D 2200/70* (2013.01)

(58) Field of Classification Search
CPC ..... F02D 41/029; F02D 2200/021; F02D 2200/0804; F02D 2201/0806; F02D 2201/0812; F02D 2201/0818; F02D 2201/101; F02D 2201/50; F02D 2201/70; F02D 2201/501
USPC ..... 60/274, 286, 295, 297, 299–301, 311
See application file for complete search history.

(56) References Cited

U.S. PATENT DOCUMENTS

| | | | | |
|---|---|---|---|---|
| 9,371,754 | B2 * | 6/2016 | Bloms | F01N 3/0256 |
| 2003/0145582 | A1 * | 8/2003 | Bunting | F02D 41/1445 60/297 |
| 2004/0098980 | A1 | 5/2004 | Montreuil et al. | |
| 2004/0123588 | A1 | 7/2004 | Stanglmaier et al. | |
| 2005/0050883 | A1 * | 3/2005 | Nishimura | F02D 41/08 60/286 |
| 2009/0188243 | A1 * | 7/2009 | Williams | F01N 3/023 60/295 |
| 2012/0227381 | A1 | 9/2012 | Oemke et al. | |
| 2014/0123628 | A1 | 5/2014 | Larose et al. | |
| 2014/0364301 | A1 * | 12/2014 | DeGeorge | F01N 3/206 502/34 |

* cited by examiner

SYSTEM FOR ADAPTIVE REGENERATION OF AFTERTREATMENT SYSTEM COMPONENTS

CROSS-REFERENCE TO RELATED APPLICATIONS

This application is a U.S. National Stage Application of PCT Application No. PCT/US2017/046755, filed on Aug. 14, 2017, which claims priority to U.S. Provisional Patent Application No. 62/375,030, filed on Aug. 15, 2016 and entitled "System for Adaptive Regeneration of Aftertreatment System Components."

TECHNICAL FIELD

The present application relates generally to the field of aftertreatment systems for internal combustion engines.

BACKGROUND

For internal combustion engines, such as diesel engines, nitrogen oxide ($NO_x$) compounds may be emitted in the exhaust. To reduce $NO_x$ emissions, a selective catalytic reduction (SCR) process may be implemented to convert the $NO_x$ compounds into more neutral compounds, such as diatomic nitrogen, water, or carbon dioxide, with the aid of a catalyst and a reductant. The catalyst may be included in a catalyst chamber of an exhaust system, such as that of a vehicle or power generation unit. A reductant, such as anhydrous ammonia, aqueous ammonia, or urea, is typically introduced into the exhaust gas flow prior to the catalyst chamber. To introduce the reductant into the exhaust gas flow for the SCR process, an SCR system may dose or otherwise introduce the reductant through a dosing module that vaporizes or sprays the reductant into an exhaust pipe of the exhaust system upstream of the catalyst chamber. The SCR system may include one or more sensors to monitor conditions within the exhaust system.

SUMMARY

Implementations described herein relate to systems for adaptive regeneration of aftertreatment system components. In particular, the system detects ambient conditions and estimates system conditions. The system then adapts a regeneration process to mitigate the effects of the regeneration process on the system based on the ambient conditions and system conditions. For instance, the system may detect the ambient temperature surrounding an engine and/or aftertreatment system and estimate system temperature conditions. If the detected ambient temperature and/or estimated system temperature conditions may affect components of the aftertreatment system, then the regeneration process may be modified (e.g., changing an initiation trigger and/or shortening a duration) to reduce the impact on the components of the aftertreatment system. For instance, if an aftertreatment system is within a limited ventilation area and/or positioned where the aftertreatment system may be susceptible to potential heat concentrations, the system can adapt the regeneration process to lower system skin temperatures to reduce the thermal impact on components of the aftertreatment system.

One implementation relates to a system that includes an aftertreatment system and a controller. The controller is configured to access one or more parameters indicative of at least one of an ambient condition and an operating, determine a regeneration type of a regeneration process for a component of the aftertreatment system, determine an application condition, and modify a parameter for the regeneration process for the component of the aftertreatment system based on the one or more parameters indicative of the ambient condition. In some implementations, the controller is further configured to initiate the regeneration process for the component of the aftertreatment system. In some implementations, the controller is further configured to access one or more parameters indicative of an operating condition. The one or more parameters indicative of an operating condition may include an aftertreatment system skin temperature, a mounting bracket temperature, a controller temperature, a vehicle frame temperature, a floorboard temperature, a body panel temperature, a building component temperature, or an engine temperature. The parameter for the regeneration process may be modified in response to at least one of the one or more parameters indicative of the ambient condition, the one or more parameters indicative of the operating condition, the determined regeneration type, and the determined application condition. The one or more parameters indicative of an ambient condition may include an ambient air temperature, a reductant tank temperature, or a particulate matter (PM) sensor temperature. The parameter for the regeneration process may be modified in response to at least one of the one or more parameters indicative of the ambient condition, the one or more parameters indicative of the operating condition, the determined regeneration type, and the determined application condition. In some implementations, the modified parameter includes a target regeneration temperature, a regeneration duration, a dwell time between regeneration process, a threshold value for the regeneration process, or a minimum regeneration temperature. In some implementations, the threshold value for the regeneration process comprises a particulate matter mass, a particulate matter storage amount, a sintering amount, a $NO_x$ storage amount, a $SO_x$ storage amount, or an ammonia storage amount.

Another implementation relates to a method that includes accessing one or more parameters indicative of at least one of an ambient condition and an operating, determining a regeneration type of a regeneration process for a component of the aftertreatment system, determining an application condition, and modifying a parameter for the regeneration process for the component of the aftertreatment system based on the one or more parameters indicative of the ambient condition, the regeneration type, and the application condition. In some implementations, the method includes initiating the regeneration process for the component of the aftertreatment system. In some implementations, the method includes accessing one or more parameters indicative of an operating condition. The one or more parameters indicative of an operating condition may include an aftertreatment system skin temperature, a mounting bracket temperature, a controller temperature, a vehicle frame temperature, a floorboard temperature, a body panel temperature, a building component temperature, or an engine temperature. The parameter for the regeneration process may be modified in response to at least one of the one or more parameters indicative of the ambient condition, the one or more parameters indicative of the operating condition, the determined regeneration type, and the determined application condition. The one or more parameters indicative of an ambient condition may include an ambient air temperature, a reductant tank temperature, or a particulate matter (PM) sensor temperature. The parameter for the regeneration process may be modified in response to at least one of the one or more parameters indicative of the ambient condition, the one or more parameters indicative of the operating condition, the determined regeneration type, and the determined application condition. In some implementations, the modified parameter includes a target regeneration temperature, a regeneration duration, a dwell time between regeneration process, a threshold value for the regeneration process, or a minimum regeneration temperature. In some implementations, the threshold value for the regeneration process comprises a particulate matter mass, a particulate matter storage amount, a sintering amount, a $NO_x$ storage amount, a $SO_x$ storage amount, or an ammonia storage amount.

A further implementation relates to an apparatus that includes an ambient air temperature check circuit that compares a measured ambient air temperature to a predetermined threshold value, a regeneration selection circuit that determines a regeneration type of a regeneration process for a component of the aftertreatment system, and a conditional regeneration target temperature arbitration circuit that determines a parameter for the regeneration process for the component of the aftertreatment system based on the measured ambient air temperature and the regeneration type. In some implementations, the apparatus includes regeneration control circuit that initiates the regeneration process for the component of the aftertreatment system. In some implementations, the conditional regeneration target temperature arbitration circuit accesses one or more parameters indicative of an operating condition. The one or more parameters indicative of an operating condition may include an aftertreatment system skin temperature, a mounting bracket temperature, a controller temperature, a vehicle frame temperature, a floorboard temperature, a body panel temperature, a building component temperature, or an engine temperature.

BRIEF DESCRIPTION

The details of one or more implementations are set forth in the accompanying drawings and the description below. Other features, aspects, and advantages of the disclosure will become apparent from the description, the drawings, and the claims, in which:

Figure 1:
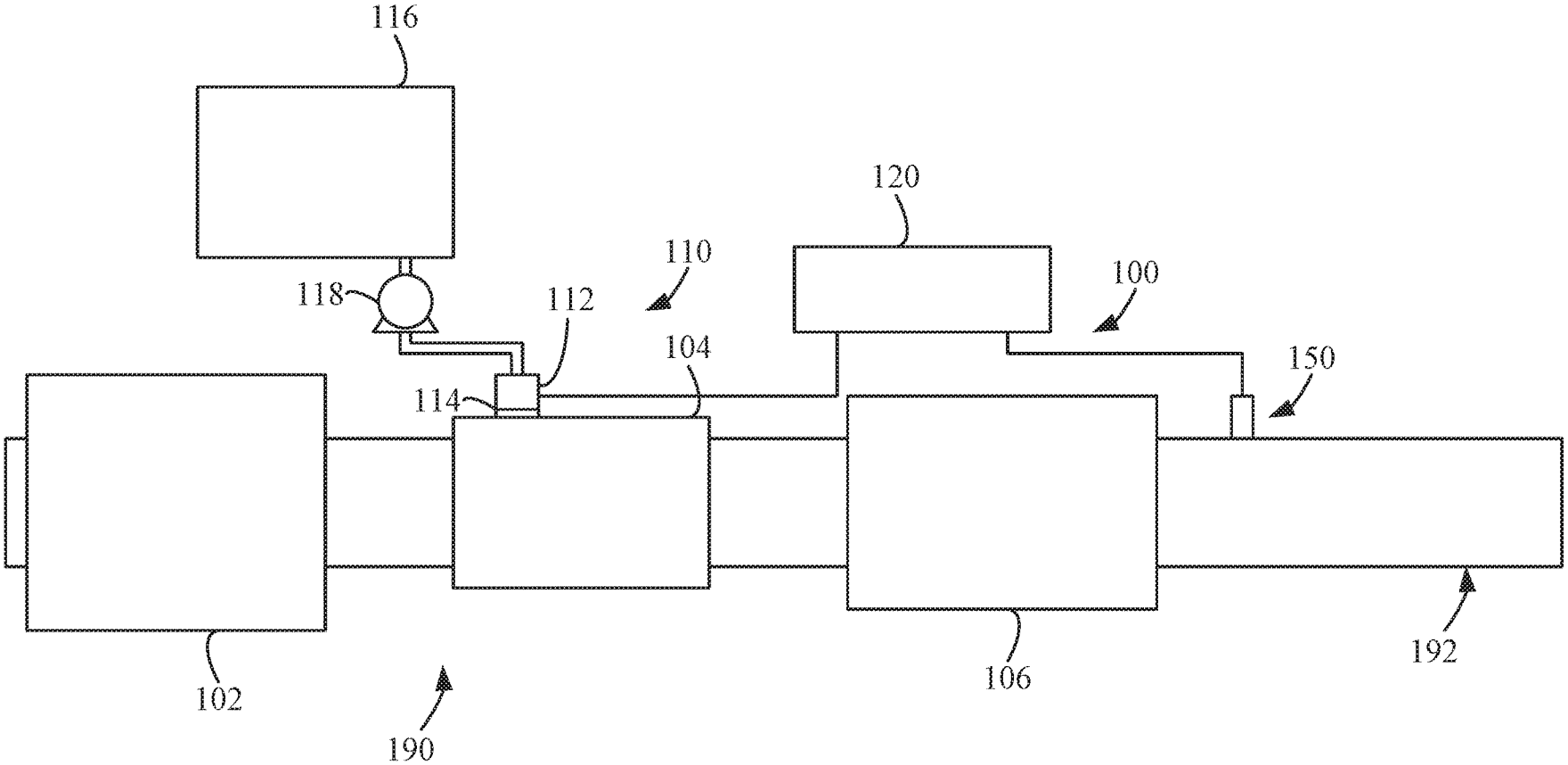
FIG. 1 is a block schematic diagram of an example selective catalytic reduction system having an example reductant delivery system for an exhaust system.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for adaptive regeneration of aftertreatment system components. The various concepts introduced above and discussed in greater detail below may be implemented in any of numerous ways, as the described concepts are not limited to any particular manner of implementation. Examples of specific implementations and applications are provided primarily for illustrative purposes.

I. Overview

In some instances, an engine having an aftertreatment system may be situated in an environment that may affect components of the aftertreatment system, such as in an enclosed or partially enclosed environment, in an unventilated environment, in a high temperature environment, in a low temperature environment, etc. The engines and aftertreatment systems may generate heat or otherwise affect the ambient conditions during operations. In some instances, a controller for the aftertreatment system may be configured to implement a regeneration process to regenerate one or more components of the aftertreatment system during operation. For instance, a diesel particulate filter (DPF) regeneration process may be performed by increasing an engine exhaust temperature via engine operating conditions and/or by introducing additional thermal heat to the exhaust downstream of the engine exhaust outlet (e.g., by injecting combustible fuel downstream of the exhaust, etc.). Similarly, other regeneration processes may be performed for other components of the aftertreatment system, such as for a selective catalytic reduction (SCR) catalyst, an ammonia oxidation (AMOX) component, etc. These regeneration processes may increase an exhaust temperature within the aftertreatment system to regenerate the components, such as by burning off captured material.

The increased exhaust gas temperature within the aftertreatment system thermally heats the pipes and/or other housings of the aftertreatment system, thereby increasing the pipe and/or other housing skin temperature that is exposed to the ambient environment. The increased skin temperature may result in convective, conductive, and/or radiative heat transfer to the atmosphere or other components near to and/or attached to the piping and/or other housing of the aftertreatment system. In some instances, the increase of thermal heat transfer to the atmosphere surrounding the aftertreatment system and/or to components coupled to the exterior of the aftertreatment system may adversely affect the operating conditions for components of the aftertreatment system or, such as in the case of a cold operating environment, may prevent adverse operating conditions for such components. Thus, providing a system for adaptive regeneration of the components of the aftertreatment system may be used to maintain operating conditions for components of the aftertreatment system from exceeding upper thermal operating conditions or lower thermal operating conditions. The adaptive regeneration system described herein may be used to affect the temperature of atmosphere surrounding the aftertreatment system and/or components directly coupled to the aftertreatment system (e.g., mounting brackets for sensors and/or the aftertreatment system itself). In some implementations, the adaptive regeneration system may be further used to permit the aftertreatment system to be fit within a smaller volume by controlling skin temperatures of the aftertreatment system to not exceed a maximum target temperature, such as a temperature for other components mounted near the aftertreatment system and/or structure components of the structure to which the aftertreatment system is attached, such as a vehicle frame, floorboard, etc., or building component.

II. Overview of Aftertreatment System

FIG. 1 depicts an aftertreatment system 100 having an example reductant delivery system 110 for an exhaust system 190. The aftertreatment system 100 includes a particulate filter (for example a diesel particulate filter (DPF) 102), a reductant delivery system 110, a decomposition chamber or reactor 104, a SCR catalyst 106, and a sensor 150.

The DPF 102 is configured to remove particulate matter, such as soot, from exhaust gas flowing in the exhaust system 190. The DPF 102 includes an inlet, where the exhaust gas is received, and an outlet, where the exhaust gas exits after having particulate matter substantially filtered from the exhaust gas and/or converting the particulate matter into carbon dioxide.

The decomposition chamber 104 is configured to convert a reductant, such as urea or diesel exhaust fluid (DEF), into ammonia. The decomposition chamber 104 includes the reductant delivery system 110 having a dosing module 112 configured to dose the reductant into the decomposition chamber 104. In some implementations, the reductant is injected upstream of the SCR catalyst 106. The reductant droplets then undergo the processes of evaporation, thermolysis, and hydrolysis to form gaseous ammonia within the exhaust system 190. The decomposition chamber 104 includes an inlet in fluid communication with the DPF 102 to receive the exhaust gas containing $NO_x$ emissions and an outlet for the exhaust gas, $NO_x$ emissions, ammonia, and/or remaining reductant to flow to the SCR catalyst 106.

The decomposition chamber 104 includes the dosing module 112 mounted to the decomposition chamber 104 such that the dosing module 112 may dose the reductant into the exhaust gases flowing in the exhaust system 190. The dosing module 112 may include an insulator 114 interposed between a portion of the dosing module 112 and the portion of the decomposition chamber 104 to which the dosing module 112 is mounted. The dosing module 112 is fluidly coupled to one or more reductant sources 116. In some implementations, a pump 118 may be used to pressurize the reductant from the reductant source 116 for delivery to the dosing module 112.

The dosing module 112 and the pump 118 are also electrically or communicatively coupled to a controller 120. The controller 120 is configured to control the dosing module 112 to dose reductant into the decomposition chamber 104. The controller 120 may also be configured to control the pump 118. The controller 120 may include a microprocessor, an application-specific integrated circuit (ASIC), a field-programmable gate array (FPGA), etc., or combinations thereof. The controller 120 may include memory which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), erasable programmable read only memory (EPROM), flash memory, or any other suitable memory from which the controller 120 can read instructions. The instructions may include code from any suitable programming language.

Figure 3:
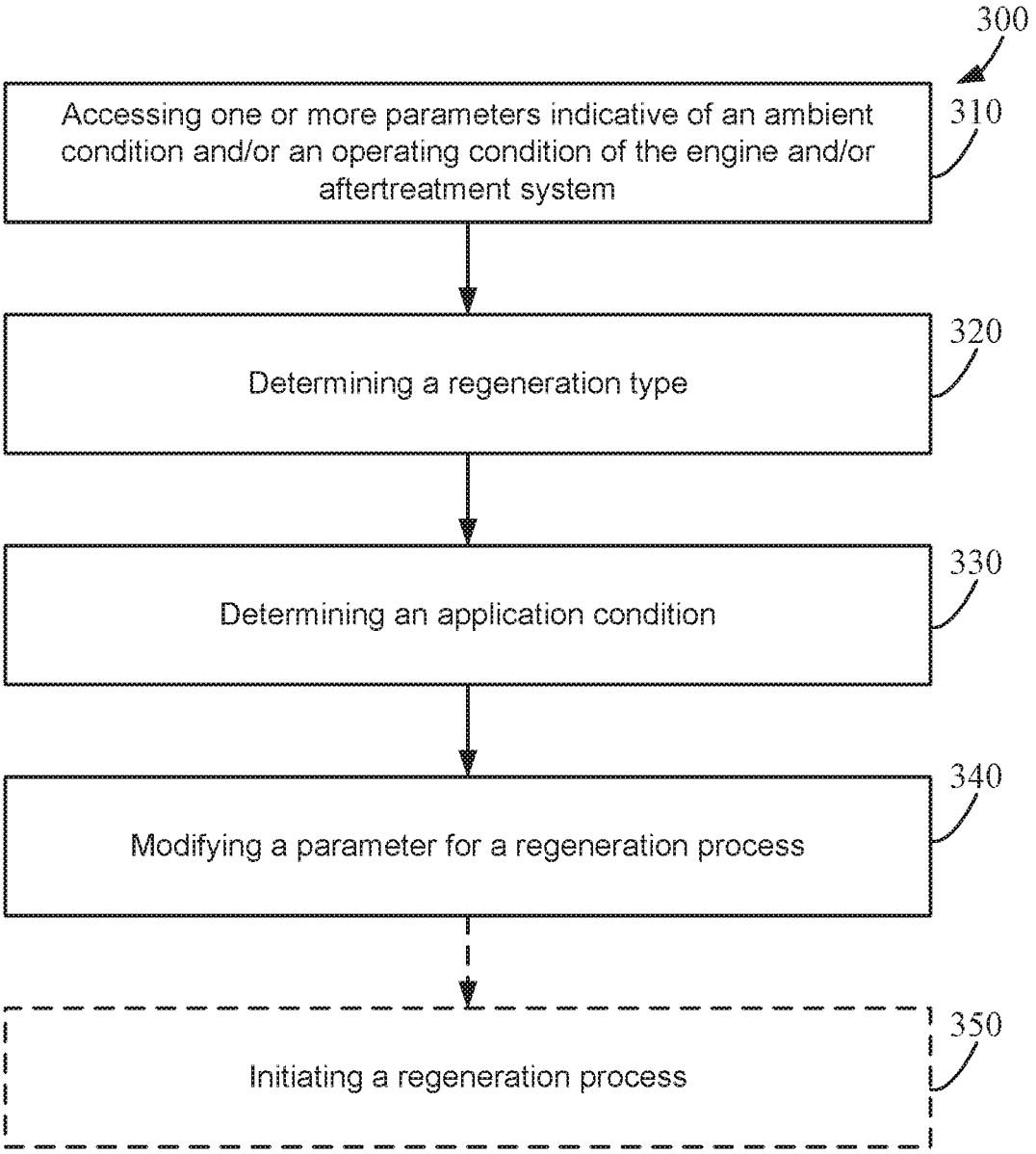
FIG. 3 is a process diagram of an implementation of a process for adaptive regeneration of an aftertreatment component.

In certain implementations, the controller 120 is structured to perform certain operations, such as those operations described herein in relation to FIG. 3. In certain implementations, the controller 120 forms a portion of a processing subsystem including one or more computing devices having memory, processing, and communication hardware. The controller 120 may be a single device or a distributed device, and the functions of the controller 120 may be performed by hardware and/or as computer instructions on a non-transient computer readable storage medium.

In certain implementations, the controller 120 includes one or more modules structured to functionally execute the operations of the controller 120. In certain implementations, the controller 120 may include a regeneration module and a regeneration adaption module for performing the operations described in reference to FIG. 3. The description herein including modules emphasizes the structural independence of the aspects of the controller 120 and illustrates one grouping of operations and responsibilities of the controller 120. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the section referencing FIG. 3.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

The SCR catalyst 106 is configured to assist in the reduction of $NO_x$ emissions by accelerating a $NO_x$ reduction process between the ammonia and the $NO_x$ of the exhaust gas into diatomic nitrogen, water, and/or carbon dioxide. The SCR catalyst 106 includes an inlet in fluid communication with the decomposition chamber 104 from which exhaust gas and reductant is received and an outlet in fluid communication with an end of the exhaust system 190.

The exhaust system 190 may further include a diesel oxidation catalyst (DOC) in fluid communication with the exhaust system 190 (e.g., downstream of the SCR catalyst 106 or upstream of the DPF 102) to oxidize hydrocarbons and carbon monoxide in the exhaust gas.

In some implementations, the DPF 102 may be positioned downstream of the decomposition chamber or reactor 104. For instance, the DPF 102 and the SCR catalyst 106 may be combined into a single unit (also referred to as an SDPF). In some implementations, the dosing module 112 may instead be positioned downstream of a turbocharger or upstream of a turbocharger.

The sensor 150 may be coupled to the exhaust system 190 to detect a condition of the exhaust gas flowing through the exhaust system 190. In some implementations, the sensor 150 may have a portion disposed within the exhaust system 190, such as a tip of the sensor 150 may extend into a portion of the exhaust system 190. In other implementations, the sensor 150 may receive exhaust gas through another conduit, such as a sample pipe extending from the exhaust system 190. While the sensor 150 is depicted as positioned downstream of the SCR catalyst 106, it should be understood that the sensor 150 may be positioned at any other position of the exhaust system 190, including upstream of the DPF 102, within the DPF 102, between the DPF 102 and the decomposition chamber 104, within the decomposition chamber 104, between the decomposition chamber 104 and the SCR catalyst 106, within the SCR catalyst 106, or downstream of the SCR catalyst 106. In addition, two or more sensor 150 may be utilized for detecting a condition of the exhaust gas, such as two, three, four, five, or size sensor 150 with each sensor 150 located at one of the foregoing positions of the exhaust system 190.

Figure 2:
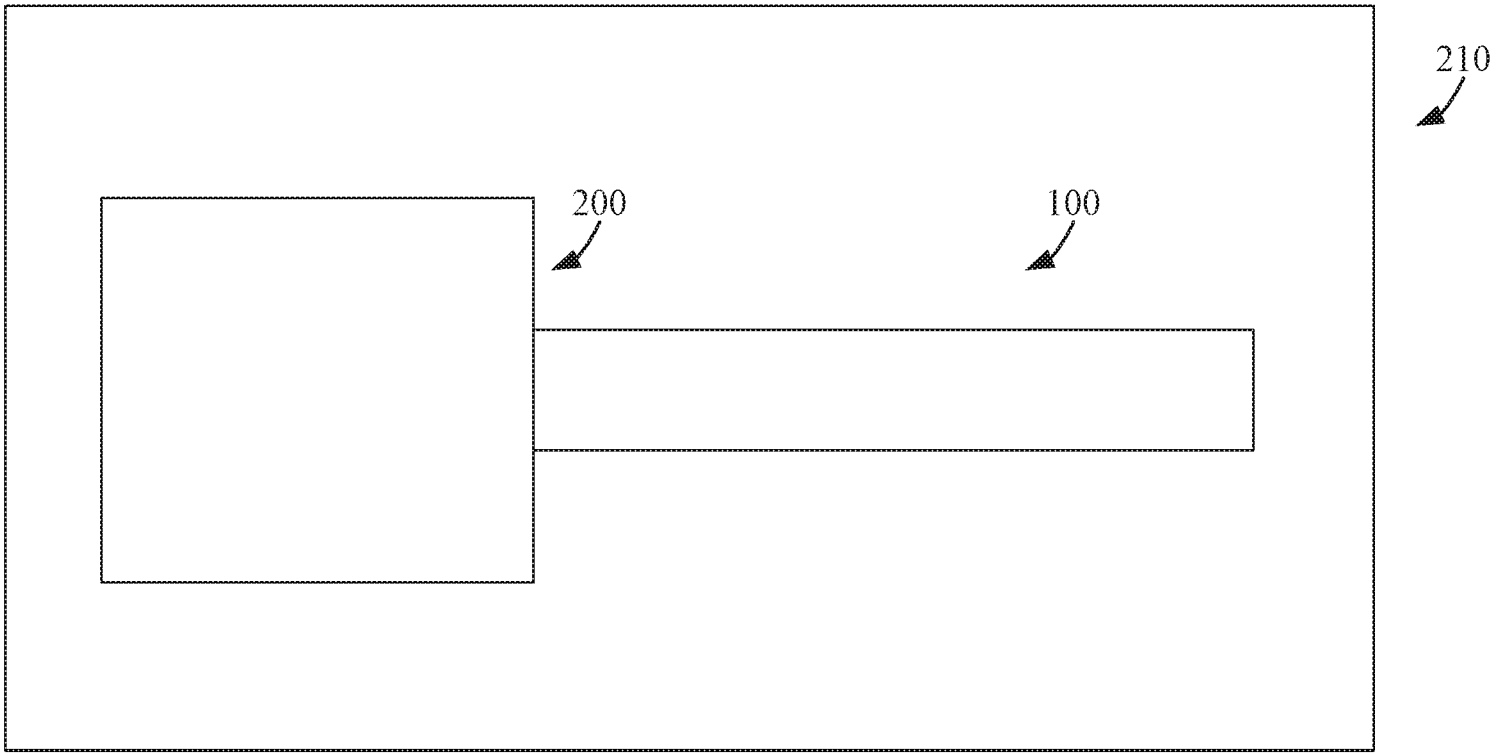
FIG. 2 is a block schematic of an engine and aftertreatment system in an environment.

As shown in FIG. 2, the aftertreatment system 100 may be coupled to an engine 200 and positioned within an environment 210. The aftertreatment system 100 may be in fluid communication with one or more exhaust manifolds of the engine to receive exhaust gas from the engine 200. In some implementations, one or more turbochargers may be positioned in fluid communication between the one or more exhaust manifolds and the aftertreatment system to receive exhaust gases for operating a compressor of each of the one or more turbochargers.

The environment 210 may be an enclosed environment, such as a generator casing, a ship compartment, etc. In some instances, the environment 210 may not be ventilated or may have reduced ventilation, such as a substantially enclosed casing that is stationary. In other implementations, the environment 210 may include other components and/or structures associated with the engine 200 and/or aftertreatment system 100. For instance, the environment 210 may include one or more mounting brackets for mounting the aftertreatment system 100 and/or the engine 200. In other implementations, the environment 210 may include a vehicle frame, a floorboard, a body panel, a vehicle sensor, a vehicle controller, etc. In further implementations, the environment 210 may include building or other structural elements, such as a wall, divider, support beam, etc. In some instances, the aftertreatment system 100 itself may include components affected by thermal conditions of the environment 210. For instance, electrical components for the aftertreatment system 100 may be mounted to the exterior of a pipe or other housing of the aftertreatment system 100. In some instances, the electrical components may include sensors, such as a particulate matter sensor, $NO_x$ sensor, $NH_3$ sensor, $CO_2$ sensor, CO sensor, temperature sensor, pressure sensor, delta pressure sensor, mass flow sensor, etc. The sensors may be mounted via mounting brackets to the pipe or other housing component of the aftertreatment system 100. In some other instances, the electrical components may include one or more controllers or other electronic components for controlling the operation of the aftertreatment system 100, the engine 200, and/or other apparatuses associated with the engine 200, the aftertreatment system 100, or a vehicle or structure in which the engine 200 and/or aftertreatment system 100 is mounted.

III. Implementations of Adaptive Regeneration System

Referring generally to FIG. 3, the process 300 may be implemented by a controller, such as controller 120 of FIG. 1, to adaptively control one or more regeneration processes for regenerating components of an aftertreatment system, such as aftertreatment system 100. The process 300 detects and/or estimates ambient and/or system conditions, and, responsive to the detected and/or estimated ambient and/or system conditions, adapts one or more parameters for a regeneration process. In some implementations, such as situations where high thermal conditions for an environment in which the engine and/or aftertreatment system is operating, the adaption of the regeneration process may mitigate increases in thermal temperatures of the aftertreatment system and/or engine, the atmosphere in which the engine and/or aftertreatment system is operating, thermal concentrations relative to the engine and/or aftertreatment system and/or thermal conditions of components coupled to, positioned near to, or otherwise affected by increases in thermal temperature from the engine and/or aftertreatment system. For instance, an aftertreatment may be installed in an enclosed or confined space with minimum ventilation flow, which can result in the heat generated by a regeneration process of the aftertreatment system to not be easily dissipated. The heat generation from the regeneration process may result in thermal concentrations as the generated heat rises to the top, which may impact one or more components of the engine and/or aftertreatment system and/or other components coupled thereto, positioned near to, or otherwise thermally affected by the regeneration process.

In other implementations, such as situations where low thermal conditions for an environment in which the engine and/or aftertreatment system is operating, the adaption of the regeneration process may increase thermal temperatures of the aftertreatment system and/or engine, the atmosphere in which the engine and/or aftertreatment system is operating, thermal concentrations relative to the engine and/or aftertreatment system and/or thermal conditions of components coupled to, positioned near to, or otherwise affected by increases in thermal temperature from the engine and/or aftertreatment system.

The process 300 includes accessing one or more parameters indicative of an ambient condition and/or an operating condition of the engine and/or aftertreatment system (block 310), determining a regeneration type (block 320), determining an application condition (block 330), modifying a parameter for a regeneration process (block 340), and, in some instances, initiating a regeneration process (block 350).

Accessing one or more parameters indicative of an ambient condition and/or and operating condition of the engine and/or aftertreatment system (block 310) may include accessing a parameter stored in a memory of a controller and/or accessing a parameter from a sensor. In some implementations, the parameters may include an ambient air temperature, a reductant tank temperature (e.g., a DEF tank temperature in particular embodiments), and a PM sensor temperature. The ambient air temperature may be measured by an ambient temperature sensor and/or determined based on other parameters, such as a parameter of an air intake temperature, etc. The DEF tank temperature may be measured by a DEF tank temperature sensor and/or determined based on other parameters, such as a parameter of a doser DEF temperature, etc. The PM sensor temperature may be measured by a temperature sensor near to or coupled to the PM sensor temperature and/or may be a temperature measure by the PM sensor itself. Other ambient conditions and/or operating conditions of the engine and/or aftertreatment system may have parameters that may be accessed as well, such as an aftertreatment system skin temperature, a mounting bracket temperature, a controller temperature, a vehicle frame temperature, a floorboard temperature, a body panel temperature, a building component temperature, an engine temperature, etc.

Based on the ambient conditions and/or operating conditions of the engine and/or aftertreatment system, the process applies an adaption to control a regeneration process. In some implementations, this may include lowering regeneration target temperature to reduce the heat generated and/or other modifications.

The process 300 includes determining a regeneration type (block 320). For some regeneration processes, a high temperature and/or operating condition affect the effectiveness of the regeneration process. Thus, the process 300 determines a type of regeneration process that may be about to occur and/or is next to occur based on conditions of the components of the aftertreatment system. In some implementations, the process 300 can determine all enabled regeneration processes for the aftertreatment system and/or can determine all regeneration processes that will or are likely to occur in a predetermined future period of time (e.g., in the next hour, two hours, three hours, four hours, five hours, six hours, twelve hours, twenty-four hours, etc.).

The process 300 includes determining an application condition (block 330). The application condition may be the current operational mode of the engine or other operational conditions for the engine coupled to the aftertreatment system. Similar to the high temperature needed for certain regeneration processes, some regeneration processes may affect the operation of the engine, such as reducing the speed of the engine, increasing the speed of the engine, etc. Thus, the determination of the application condition may determine a vehicle speed and/or an operational mode. The operational mode may include a mission or non-mission operational mode (e.g., an operating or idle condition). In some implementations, the process 300 determines the current application conditions and/or is next to occur. In some instances, the process 300 can determine all enabled application conditions and/or can determine all application conditions that will or are likely to occur in a predetermined future period of time (e.g., in the next hour, two hours, three hours, four hours, five hours, six hours, twelve hours, twenty-four hours, etc.).

The process 300 further includes modifying a parameter for a regeneration process (block 340). In some implementations, the modified parameter may be a target regeneration temperature, a regeneration duration, a dwell time between regeneration process, a threshold value for the regeneration process (e.g., a particulate matter mass and/or storage amount, a sintering amount, a $NO_x$ and/or ammonia storage amount, a sulfur oxide ($SO_x$) storage amount etc.), a minimum regeneration temperature, etc. In some instances, combinations of two or more foregoing parameters may be modified. The modified parameters affect the operation of a regeneration process.

For instance, the target regeneration temperature may be reduced to reduce the bulk temperature and heat generated by the regeneration process or increased to increase the bulk temperature and heat generated by the regeneration process. In some instances, the regeneration duration, dwell time between regeneration processes, threshold value for the regeneration process, and/or minimum regeneration temperature may be adjusted based on the lower regeneration target temperature.

In some instances, the regeneration duration may be reduced to reduce the bulk temperature and heat generated by the regeneration process or increased to increase the bulk temperature and heat generated by the regeneration process. In some instances, the target regeneration temperature, dwell time between regeneration processes, threshold value for the regeneration process, and/or minimum regeneration temperature may be adjusted based on the reduced regeneration duration.

In some instances, the dwell time between regeneration processes may be increased to increase the time for the temperature and heat generated by the regeneration process to dissipate or reduced to decrease the time for the temperature and heat generated by the regeneration process to dissipate. In some instances, the target regeneration temperature, regeneration duration, threshold value for the regeneration process, and/or minimum regeneration temperature may be adjusted based on the reduced regeneration duration.

In some instances, the threshold value for the regeneration process may be increased or decreased to decrease or increase the frequency of the regeneration process to increase or decrease the time for the temperature and heat generated by the regeneration process to dissipate. In some instances, the target regeneration temperature, regeneration duration, dwell time between regeneration processes, and/or minimum regeneration temperature may be adjusted based on the reduced regeneration duration.

In some instances, the minimum regeneration temperature may be increased or decreased to decrease or increase the frequency of the regeneration process to increase or decrease the time for the temperature and heat generated by the regeneration process to dissipate. In some instances, the target regeneration temperature, regeneration duration, dwell time between regeneration processes, and/or threshold value for the regeneration process may be adjusted based on the reduced regeneration duration.

Thus, the process 300 provides adaptation to the regeneration process responsive to the ambient and/or operating conditions, the regeneration type, and the application condition. In some implementations, the process 300 further includes initiating a regeneration process (block 350). The initiated regeneration process may be based on one or more of the modified parameters and/or may be adjusted based on the one or more modified parameters. The regeneration process may affect one or more operating conditions of the engine and/or aftertreatment system to increase or decrease the temperature of the exhaust gas, increase or decrease a mass flow, and/or increase or decrease a flow velocity to regenerate a component of the aftertreatment system, such as a DPF, SCR catalyst, AMOX, sensor, etc.

Figure 4:
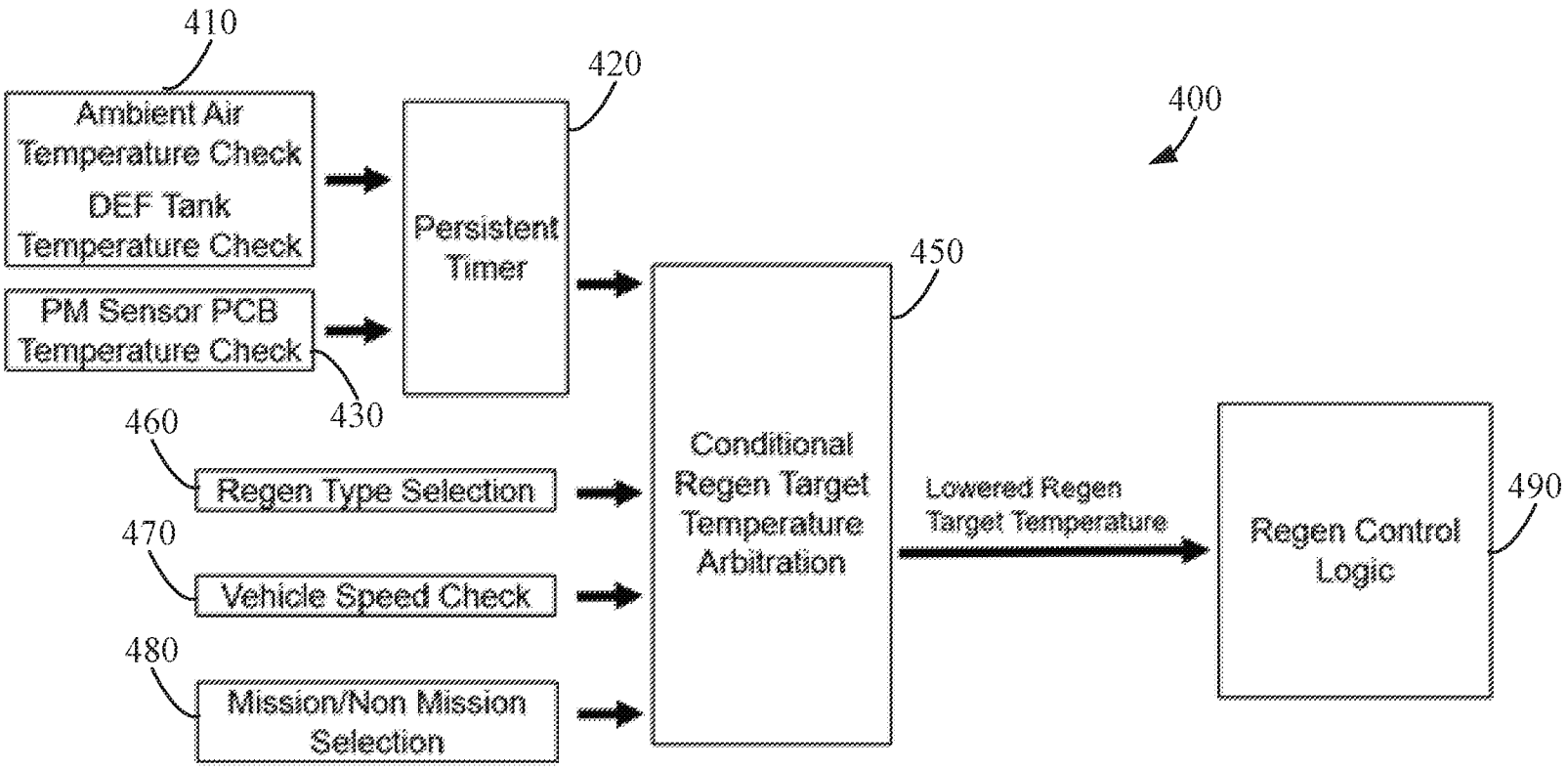
FIG. 4 is a control diagram of an implementation of a process for adaptive regeneration of an aftertreatment component.

FIG. 4 depicts a control diagram of an implementation of a process 400 for adaptive regeneration of an aftertreatment component. The process 400 lowers a regeneration target temperature to reduce the heat generated by the regeneration process. When a regeneration is requested, the minimum of the lowered regeneration target temperature and a current target temperature may be selected as the regeneration target temperature for the regeneration process.

The process 400 can include an ambient air temperature check and/or DEF tank temperature check 410. The ambient air temperature check and/or DEF tank temperature check 410 can compare a measured ambient air temperature to a threshold ambient air temperature and/or a DEF tank temperature to a threshold DEF tank temperature. In some implementations, a timer 420 can be implemented such that the an ambient air temperature check and/or DEF tank temperature check 410 is performed at predetermined time intervals based on the timer 420. A particulate matter sensor temperature check 430 may also occur at predetermined time intervals based on the timer 420 as well. The particulate matter sensor temperature check 430 can compare a measured particulate matter sensor temperature, such as a temperature of the sensor itself or a controller or printed circuit board for the particulate matter sensor. A parameter can be passed to a conditional regeneration target temperature arbitration system 450. The parameter can be indicative of one or more of a pass and/or fail of the ambient air temperature check and/or DEF tank temperature check 410 and/or the particulate matter sensor temperature check 430. In some implementations, more than one parameter can be passed responsive to the ambient air temperature check and/or DEF tank temperature check 410 and/or the particulate matter sensor temperature check 430.

The conditional regeneration target temperature arbitration system 450 can also receive one or more parameters indicative of a regeneration type selection 460, vehicle speed check 470, and/or mission or non-mission selection 480. The regeneration type selection 460 can determine a regeneration type or types a and pass one or more parameters indicative of the regeneration type or types. For some regeneration processes, a high temperature and/or operating condition affect the effectiveness of the regeneration process. Thus, the regeneration type selection 460 determines a type of regeneration process that may be about to occur and/or is next to occur based on conditions of the components of the aftertreatment system. In some implementations, the regeneration type selection 460 can determine all enabled regeneration processes for the aftertreatment system and/or can determine all regeneration processes that will or are likely to occur in a predetermined future period of time (e.g., in the next hour, two hours, three hours, four hours, five hours, six hours, twelve hours, twenty-four hours, etc.).

The vehicle speed check 470 can compare a measured vehicle speed to a threshold vehicle speed. The vehicle speed may be an engine speed, a transmission speed, and/or speed. For certain regeneration processes, the regeneration process may affect the operation of the engine, such as reducing the speed of the engine, increasing the speed of the engine, etc. Thus, the vehicle speed check 470 can compare the vehicle speed relative to a threshold vehicle speed value to determine if the regeneration target temperature can be adjusted based on the regeneration process relative to the vehicle speed. Similarly, the mission or non-mission selection 480 check can determine a mission or non-mission operational mode (e.g., an operating or idle condition of the engine).

The conditional regeneration target temperature arbitration system 450 can arbitrate the passed parameters indicative of the ambient air temperature and/or DEF tank temperature check, 410, the PM sensor temperature check 430, the regeneration type selection 460, the vehicle speed check 470, and the mission or non-mission selection 480 check to determine whether to lower a regeneration target temperature and to what lower temperature level the regeneration target temperature should be based on the passed parameters and/or to maintain an original regeneration target temperature.

If a lowered regeneration target temperature is selected, a parameter indicative of the lowered regeneration target temperature is passed to the regeneration control logic 490 for the corresponding regeneration process.

As described herein, the system for adaptive regeneration of an aftertreatment system component can estimate a heat concentration condition based on measurement of ambient air temperature, DEF tank temperature and PM sensor temperature. Based on the estimated heat concentration condition, the system can then adapt one or more parameters for a regeneration process to control the regeneration process. In some implementations, a lowered regeneration target temperature is determined based on the estimated heat concentration condition, regeneration type(s), vehicle speed, and operational mode.

The term "controller" encompasses all kinds of apparatus, devices, and machines for processing data, including by way of example a programmable processor, a computer, a system on a chip, or multiple ones, a portion of a programmed processor, or combinations of the foregoing. The apparatus can include special purpose logic circuitry, e.g., an FPGA or an ASIC. The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code).

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, the separation of various system components in the implementations described above should not be understood as requiring such separation in all implementations, and it should be understood that the described components and systems can generally be integrated in a single product or packaged into multiple products embodied on tangible media.

As utilized herein, the terms "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

The terms "fluidly coupled," "in fluid communication," and the like as used herein mean the two components or objects have a pathway formed between the two components or objects in which a fluid, such as water, air, gaseous reductant, gaseous ammonia, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system comprising:

an aftertreatment system; and a controller configured to:

access one or more parameters indicative of an ambient temperature condition within a casing enclosing the aftertreatment system, determine a regeneration type of a regeneration process for a component of the aftertreatment system, determine an application condition, determine a target temperature for the regeneration process, and decrease the target temperature based on the one or more parameters indicative of the ambient temperature condition within the casing enclosing the aftertreatment system.

2. The system of claim 1, wherein the controller is further configured to initiate the regeneration process for the component of the aftertreatment system.

3. The system of claim 1, wherein the controller is further configured to access one or more parameters indicative of an operating condition.

4. The system of claim 3, wherein the one or more parameters indicative of the operating condition comprise at least one of: an aftertreatment system skin temperature, a mounting bracket temperature, a controller temperature, a vehicle frame temperature, a floorboard temperature, a body panel temperature, a building component temperature, or an engine temperature.

5. The system of claim 3, wherein the target temperature for the regeneration process is modified in response to at least one of: the one or more parameters indicative of the ambient temperature condition within the casing enclosing the aftertreatment system, the one or more parameters indicative of the operating condition, the determined regeneration type, or the determined application condition.

6. The system of claim 1, wherein the one or more parameters indicative of the ambient temperature condition within the casing enclosing the aftertreatment system comprise at least one of: an ambient air temperature, a reductant tank temperature, or a particulate matter sensor temperature.

7. The system of claim 1, wherein the controller is further configured to modify at least one of: a parameter for a regeneration duration, a dwell time between regeneration processes, a threshold value for the regeneration process, or a minimum regeneration temperature.

8. The system of claim 7, wherein the threshold value for the regeneration process comprises at least one of: a particulate matter mass, a particulate matter storage amount, a sintering amount, a $NO_x$ storage amount, a SOX storage amount, or an ammonia storage amount.

9. A method comprising:

accessing one or more parameters indicative of an ambient temperature condition within a casing enclosing an aftertreatment system;

determining a regeneration type of a regeneration process for a component of the aftertreatment system;

determining an application condition;

determining a target temperature for the regeneration process; and decreasing the target temperature based on the one or more parameters indicative of the ambient temperature condition within the casing enclosing the aftertreatment system, the regeneration type, and the application condition.

10. The method of claim 9, further comprising initiating the regeneration process for the component of the aftertreatment system.

11. The method of claim 9, further comprising accessing one or more parameters indicative of an operating condition.

12. The method of claim 11, wherein the one or more parameters indicative of the operating condition comprise at least one of: an aftertreatment system skin temperature, a mounting bracket temperature, a controller temperature, a vehicle frame temperature, a floorboard temperature, a body panel temperature, a building component temperature, or an engine temperature.

13. The method of claim 11, wherein the target temperature for the regeneration process is modified in response to at least one of: the one or more parameters indicative of the ambient temperature condition within the casing enclosing the aftertreatment system, the one or more parameters indicative of the operating condition, the determined regeneration type, or the determined application condition.

14. The method of claim 9, wherein the one or more parameters indicative of the ambient temperature condition within the casing enclosing the aftertreatment system comprise at least one of: an ambient air temperature, a reductant tank temperature, or a particulate matter sensor temperature.

15. The method of claim 9, further comprising modifying at least one of: a parameter for a regeneration duration, a dwell time between regeneration processes, a threshold value for the regeneration process, or a minimum regeneration temperature.

16. The method of claim 15, wherein:

the threshold value for the regeneration process is modified; and the threshold value for the regeneration process comprises at least one of: a particulate matter mass, a particulate matter storage amount, a sintering amount, a $NO_x$ storage amount, a $SO_x$ storage amount, or an ammonia storage amount.

17. An apparatus comprising:

an ambient air temperature check circuit that compares a measured ambient air temperature within a casing enclosing an aftertreatment system to a predetermined threshold value;

a regeneration selection circuit that determines a regeneration type of a regeneration process for a component of the aftertreatment system; and a conditional regeneration target temperature arbitration circuit that determines a target temperature for the regeneration process and decreases the target temperature based on the measured ambient air temperature within the casing enclosing the aftertreatment system and the regeneration type.

18. The apparatus of claim 17, further comprising a regeneration control circuit that initiates the regeneration process for the component of the aftertreatment system.

19. The apparatus of claim 17, wherein the conditional regeneration target temperature arbitration circuit accesses one or more parameters indicative of an operating condition.

20. The apparatus of claim 19, wherein the one or more parameters indicative of the operating condition comprise at least one of: an aftertreatment system skin temperature, a mounting bracket temperature, a controller temperature, a vehicle frame temperature, a floorboard temperature, a body panel temperature, a building component temperature, or an engine temperature.

* * * * *